US005516151A

United States Patent [19]

Mund et al.

[11] Patent Number: 5,516,151

[45] Date of Patent: May 14, 1996

[54] CLIPBOARD

[75] Inventors: John W. Mund, Fox Lake, Wis.; Cari Burns; Robert Chieda, both of Wheaton, Ill.; Leon C. Clouser, Jr., Lombard; Robert A. O'Neil, Glen Ellyn, both of Ill.

[73] Assignee: Sterling Plastics, Inc., Madison, Wis.

[21] Appl. No.: 81,434

[22] Filed: Jun. 22, 1993

[51] Int. Cl.[6] ..... B42D 3/00

[52] U.S. Cl. ..... 281/45; 24/67.11; 248/452

[58] Field of Search ..... 281/42, 45, 46; 24/67.1, 67.11; 248/441.1, 450, 451, 452

[56] References Cited

U.S. PATENT DOCUMENTS

| | | | |
|---|---|---|---|
| 502,574 | 8/1893 | Munson et al. | 281/46 |
| 1,800,362 | 4/1931 | Shipman | 281/45 |
| 2,285,235 | 6/1942 | Taubent | 281/45 |
| 2,486,253 | 10/1949 | Bresler | 281/45 X |
| 2,500,468 | 3/1950 | Postell | 281/45 X |
| 4,375,296 | 3/1983 | Chang | 281/45 |
| 4,496,058 | 1/1985 | Harris et al. | 281/45 X |
| 4,603,883 | 8/1986 | Barbieri et al. | 281/45 |

*Primary Examiner*—Willmon Fridie
*Attorney, Agent, or Firm*—Foley & Lardner

[57] ABSTRACT

A clipboard, which may include an easel support, includes a pair of spaced apart and parallel raised side ridges adapted to confine paper so that it does not move during use of the product. In one embodiment, in which an easel support is built into the back of the clipboard, the product may be used to display information provided on sheets of paper or a pad or a tablet thereof.

17 Claims, 1 Drawing Sheet

CLIPBOARD

BACKGROUND OF THE INVENTION

1. Field of the Invention

The present invention relates generally to the field of school and office supplies and more particularly to the field of clipboards used to provide rigid support for someone writing on a sheet of paper or a tablet. The present invention also relates to the field of clipboards of the type which include an easel support built into the back thereof.

2. Description of the Prior Art

Clipboards have been known for many years, probably the most common example of which is a clipboard including a generally rectangular, press board or plastic back and a spring clip mounted adjacent one end of the short side of the rectangle and adapted to receive sheets of paper, for example a tablet or a legal pad. Clipboards are known for use in a variety of sizes, including ones designed for use with standard 8½×11 inch paper, and longer versions used for legal size paper. Smaller clipboards are also known for use with notepaper and the like.

It is also known in the art that easel-type supports may be used with clipboards, so that the clipboard may be placed on a level surface and be used to display information contained on the paper held by the clip. One well-known type of support is that used for supporting picture frames, in which a portion of the back is hingedly mounted to be rotated to a position where it is at an angle to the back of the object. In such position, and with appropriate design of the bottom of the support, the object will stand on the end opposite the clip.

One frequently encountered problem with clipboards is the tendency of the paper or tablet held by the clip to move, especially if the clipboard is used without placing it on a firm support surface. For example, someone standing and using a clipboard for taking notes may exert pressures as he or she is writing which will cause the paper to twist from its normal position. The problem is especially pronounced if the sheets of paper or the pad or tablet is thin, in which case the spring-imposed pressure of the clip is less than if more sheets or a larger pad or tablet was employed.

A clipboard of the standard type or one which could be adapted to include an easel-type support, and which prevents paper or a pad or tablet from twisting on the surface of the board would represent a significant advance in the art.

SUMMARY OF THE INVENTION

The present invention features a clipboard which is capable of preventing twisting of individual sheets of paper or a tablet when used. The present invention further features a design for achieving that result, whether the clipboard be of the standard variety with a plain back, or the type which includes an easel-type support. The invention further features a clipboard which is adaptable to a wide variety of sizes and shapes of paper and which itself may be constructed from a variety of materials to accomplish utilitarian as well as aesthetic purposes.

How the features of the invention are accomplished will be described in the following detailed description of the preferred embodiment of the invention, taken in conjunction with the drawings. Generally, however, the features are accomplished by a clipboard which includes a planar surface for supporting paper or a pad or tablet of a particular size and which includes a clip mounted on that surface under which an edge of the paper, pad or tablet can be inserted. The clipboard further includes a pair of raised, spaced apart and parallel ridges extending along the sides of the clipboard, the spacing between the inner edges of the ridges being coincident with the width of the paper with which the clipboard is to be used. The edges prevent movement of the paper during use, as well as a unique decorative appearance. Other ways in which the features of the invention are accomplished will become apparent to those skilled in the art after the present specification has been read and understood. Such other ways are deemed to fall within the scope of the invention if they fall within the scope of the claims which follow.

DESCRIPTION OF THE DRAWINGS

Like components are illustrated by like reference numerals in the various figures.

DETAILED DESCRIPTION OF THE PREFERRED EMBODIMENT

Figure 3:
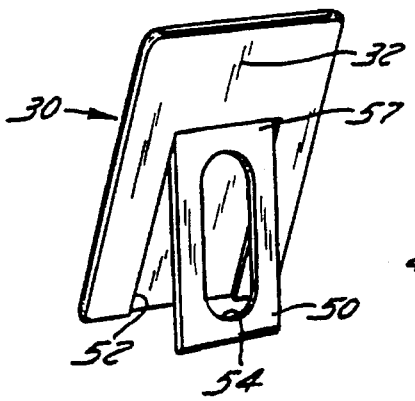
FIG. 3 is a rear perspective view of an alternate embodiment of the present invention and illustrating an easel-type support for the clipboard.
Figure 2:
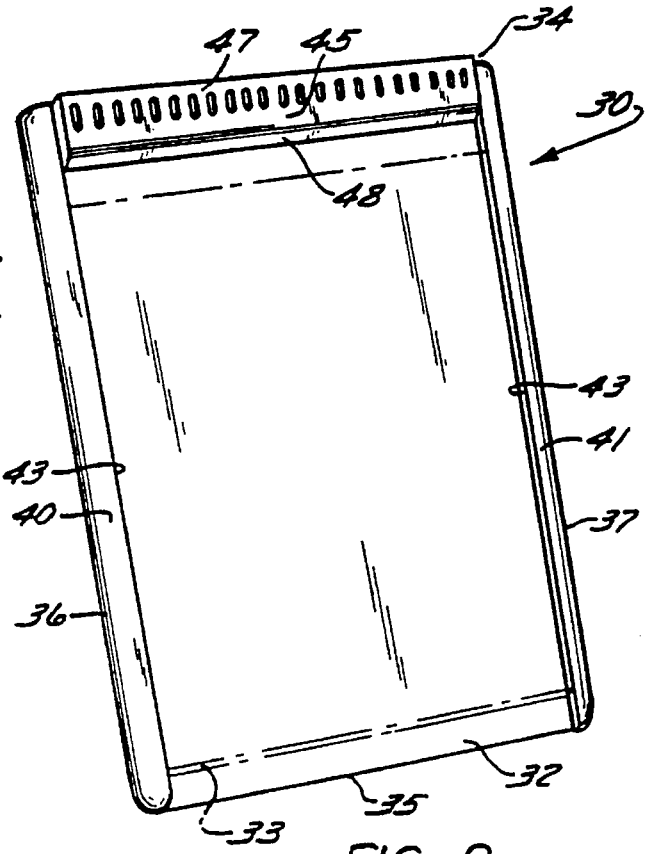
FIG. 2 is a top plan view of a clipboard according to one preferred embodiment of the present invention.

Before proceeding to the detailed description of the figures and the preferred embodiments represented by FIGS. 2 and 3, several general comments should be made about the scope and applicability of the present invention.

While the present invention is illustrated in connection with a clipboard designed for use with a pad of 8½×11 inch paper (not including the section which is retained by the clip), the principles of the present invention can be expanded to a wide variety of different paper sizes. Furthermore, a number of design elements can be incorporated without departing from the invention's intended scope. For example, the prior art clipboard is shown to have rounded corners, but square corners are also known. The particular type of clip which can be employed is also not, in and of itself, relevant to the scope of the present invention. Two styles of clips are illustrated, one in connection with the prior art clipboard shown in FIG. 1 and the other in FIG. 2. The length of the clip extending across the clipboard may be varied up to the width of the paper, and the particular characteristics of the spring mechanism used to permit insertion and withdrawal of the sheets, pad or tablet can vary widely. Any type of clip known to the art could be substituted for those illustrated.

With regard to materials of construction, these can also vary widely. Press board, plastic and the like are presently used, and similar materials which exhibit the desired rigidity and toughness for clipboard applications can be substituted.

Lastly, one particular type of easel arrangement is shown in FIG. 3, but numerous other types of easel supports are known in the display and picture frame arts which could be substituted therefor.

Figure 1:
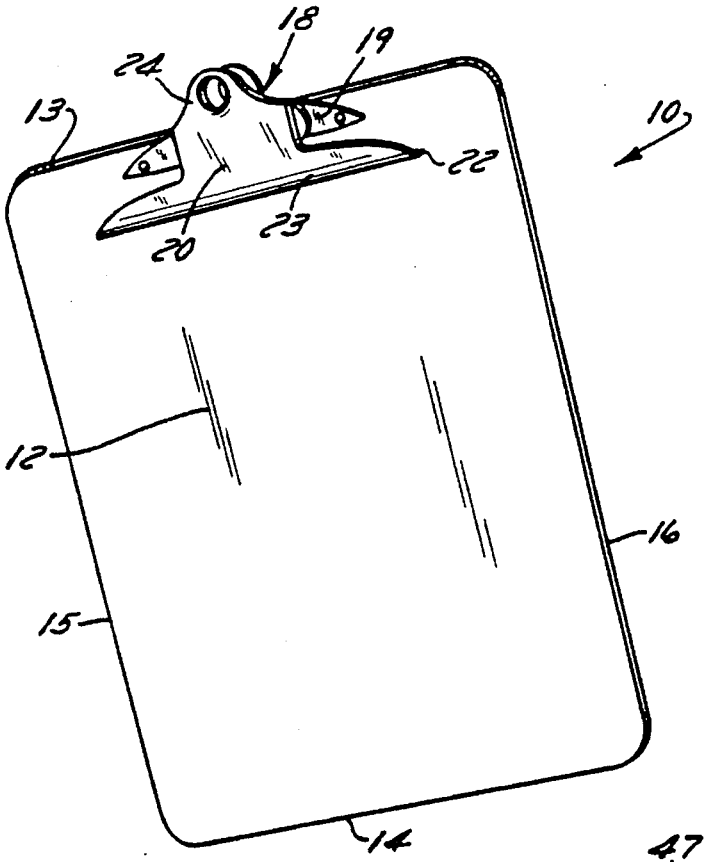
FIG. 1 PRIOR ART
FIG. 1 is a perspective view of a prior art clipboard having rounded corners and a spring clip at one end.

Proceeding now to FIG. 1, a clipboard 10 according to the prior art is illustrated to include a generally rectangular plate 12 having narrower sides 13–14 and longer sides 15–16. Located near side 13 is a clip 18 including a first portion 19 attached to plate 12 and a second portion 20 hingedly mounted to portion 19 in such a manner that an elongate edge 22 of element 20 is urged toward plate 12. An opposite end 24 of element 20 is pivotable toward element 19 to raise and lower portion 23 to permit the insertion and removal of a sheet or sheets of paper, a pad or a tablet.

Proceeding next to FIG. 2, a preferred embodiment of the present invention is illustrated to include a clipboard 30 having a generally rectangular backing 32, a portion of which is shown below the cutaway portion of the legal pad 33. Clipboard 30 includes shorter upper and lower ends 34 and 35, respectively, and side edges 36 and 37, respectively. The particular clipboard 30 is designed to hold a legal pad having detachable 8½×11 inch sheets of paper. The overall dimensions of such a legal pad might exceed 11 inches in the long direction by ¾ -inch or more.

Unlike the prior art clipboard 10 where the width of plate 12 is approximately equal to the width of the paper to be used, clipboard 30 is wider, plate 32 having a width of approximately 9½ inches. Extending along either side 36 and 37 are a pair of parallel and spaced apart ridges 40 and 41 which, in the most preferred form, extend the entire length of sides 36 and 37. More specifically, in the preferred form of the invention, ridges 40 and 41 are integrally molded with plate 32. Ridges 40 and 41 have inner edges 43 and 44 which preferably are just slightly larger than 8½ inches between each other.

Located at end 34 of clipboard 30 is an elongate, spring loaded clip 45 extending between ridges 40 and 41. In the preferred embodiment, the clip extends the entire distance but, as previously mentioned, could extend only part of the way between the two ridges. The spring mechanism is not shown but, in and of itself, is similar to those used in prior art clipboards and does not form part of the present invention.

Unlike the clipboards of the prior art, paper, whether to be in sheet, pad or tablet form, is inserted by pressing on the upper portion 47 of clip 45, thereby raising the lower edge 48 of the clip 45. The paper is placed between the ridges 40 and 41 and held by the clip 45 when it is lowered. The paper itself is captured between the ridges 40 and 41 and the clipboard may be used without concern about the paper twisting from its proper position.

The clipboard 30 is of the type which may be held by the user or placed horizontally on a support surface. An alternate embodiment of the present invention is shown in FIG. 3, where an easel-type support 50 is hingedly mounted to the back of plate 32. A recess 52 is provided to receive the support 50 so that it can be folded out of the way for storage. The oblong opening 54 in the middle of the support is primarily for material reduction and aesthetics and does not alter the utility or play any role in the construction of the clipboard. The attachment of the upper end 57 of support 50 may be by any conventional technique of attaching a plate to another plate, i.e., by pin and socket or by the use of attached hinge elements, or the like.

While the present invention has been described in connection with two preferred embodiments, the invention can be varied as mentioned above by those skilled in the art after the present specification has been read and understood. It is not necessary that the ridges be formed integrally with the plate and they can be made separately and attached, such as through the use of adhesives. Accordingly, the invention is not to be limited by the foregoing description but is to be limited solely by the scope of the claims which follow.

What is claimed is:

1. A clipboard for rectangular paper, comprising:

a support plate having a planar top surface, a first short edge, a second short edge generally parallel with the first short edge, and a pair of generally parallel side edge extending between the first and second short edges;

a pair of spaced apart and parallel ridges on the plate arranged so that paper placed therebetween may be held against the plate by the clip, wherein the top surface of the support plate is generally planar intermediate the parallel ridges and through the second edge to allow the paper to slide across the second edge without obstruction; and a spring loaded clip pivotably mounted external to the top surface and adjacent the first short edge of the support plate, the spring loaded clip extending over at least one-third the distance between the parallel ridges.

2. The clipboard of claim 1 wherein the ridges are integral with the plate.

3. The clipboard of claim 2 wherein the plate and ridges are made from a moldable resin.

4. The clipboard of claim 1 wherein the paper is selected from the group consisting of a sheet of paper, a group of individual paper sheets, a pad of paper or a tablet of paper.

5. The clipboard of claim 1 wherein the plate is rectangular.

6. The clipboard of claim 5 wherein the ridges are located adjacent to and parallel with the side edges.

7. The clipboard of claim 6 wherein the ridges are integral with the plate.

8. The clipboard of claim 7 wherein the plate and ridges are made from a moldable resin.

9. In combination, paper of a specified width and a clipboard for the paper, the clipboard including:

a planar support having a top surface, a first short edge, a second short edge generally parallel with the first short edge, and a pair of generally parallel side edges extending between the first and second short edges, a pair of parallel and spaced apart ridges, the distance between the ridges being only slightly greater than the specified width, wherein the upper surface of the support plate is generally planar intermediate the parallel ridges and through the second edge to allow the paper to slide across the second edge without obstruction; and a spring loaded clip pivotably mounted external to the top surface and adjacent the first short edge of the support plate, the spring loaded clip extending over at least one-third the distance between the parallel ridges.

10. The invention of claim 9 wherein the ridges are integral with the support.

11. The invention of claim 9 wherein the paper is selected from the group consisting of a sheet of paper, a group of individual paper sheets, a pad of paper or a tablet of paper.

12. The invention of claim 9 wherein the support is rectangular.

13. The invention of claim 12 wherein the ridges are located adjacent to and parallel with the side edges.

14. The invention of claim 13 wherein the ridges are integral with the support.

15. A clipboard for rectangular paper, comprising:

a plate having a planar top surface, a first short edge, a second short edge generally parallel with the first short edge, and a pair of generally parallel side edges extending between the first and second short edges;

a clip adjacent the first short edge of the support plate;

a pair of spaced apart and parallel ridges on the plate arranged so paper placed therebetween may be held against the plate by the clip, wherein the upper surface of the plate is generally planar intermediate the parallel ridges and through the second edge to allow the paper to slide across the second edge without obstruction;

a pivotable support; and a hinge pivotably connecting the pivotable support to the plate to support the plate in an inclined position.

16. The clipboard of claim 15, further comprising a bottom surface having a recessed portion for receiving the pivotable support in a nested relationship when the pivotable support is pivoted into generally parallel alignment with the plate.

17. The clipboard of claim 16, wherein the support plate and pivotable support are made from moldable resin.

* * * * *